US005352166A

United States Patent [19]

Chang

[11] Patent Number: 5,352,166

[45] Date of Patent: Oct. 4, 1994

[54] MOUNTAIN CLIMBING TRAINING MACHINE

[76] Inventor: Tsan-Yun Chang, No. 13, Wuchuen First Road, Wuku Industrual Area, Taipei Hsien, Taiwan

[21] Appl. No.: 127,737

[22] Filed: Sep. 28, 1993

[51] Int. Cl.[5] ..... A63B 22/04; A63B 7/00

[52] U.S. Cl. ..... 482/52; 482/37

[58] Field of Search ..... 482/52, 53, 37, 54, 482/51

[56] References Cited

U.S. PATENT DOCUMENTS

| | | | |
|---|---|---|---|
| 3,592,466 | 7/1971 | Parsons | 482/53 |
| 4,925,183 | 5/1990 | Kim | 482/54 |
| 5,125,877 | 6/1992 | Brewer | 482/37 |

FOREIGN PATENT DOCUMENTS

| | | | |
|---|---|---|---|
| 0646998 | 2/1979 | U.S.S.R. | 482/37 |

*Primary Examiner*—Stephen R. Crow

*Attorney, Agent, or Firm*—Bacon & Thomas

[57] ABSTRACT

A mountain climbing training machine includes a conveyor belt with a number of shell plates fastened onto the conveyor belt. The shell plates have associated irregular contours defined by rock-like protrusions. The shell plates are secured at spaced locations along the rotating conveyor belt. The shell plates provide a treading surface while the conveyor belt rotates. As arranged, the shell plates go around the semi-circular surfaces of revolving shafts at both ends of the conveyor belt without producing a build-up of resistance in the process.

3 Claims, 4 Drawing Sheets

MOUNTAIN CLIMBING TRAINING MACHINE

BACKGROUND OF THE INVENTION

There are numerous conventional physical training machines, but if such exercise machines are viewed in terms of types found on the market and in exercise clinics and analyzed according to function, most can be categorized as running machines, weight lifting machines, waist trimmers and other single function exercise machines, while consideration of another type of multi-function exercise machine would categorize such devices into two types, with the former type being relatively smaller in size and the latter type being relatively large and having more functional aspects. Both types are purchased according to consumer requirements and the functions of these exercise machines are all similar with few differences, utilizing a design technology based on the principles of leverage and elasticity in which the only variances are slight changes in shape, and since it is upon these minor differences that their respective patents are based, therefore the structure of the invention herein has absolutely nothing in common with conventional exercise machines, furthermore, the invention herein utilizes a simple structure that can attain its projected functions as a new structure health mountain climbing training machine of innovative design.

SUMMARY OF THE INVENTION

The invention herein relates to a kind of new structure health mountain climbing training machine that utilizes a number of different surface shape groups and similar variegated shell plates shaped as stone protrusions which serve as points of stepping contact and the center area on the two sides of each shell plate constituting a group serves as a point of support and are also distributed in a fixed arrangement on the rotating conveyor belt. During usage when the conveyance is proceeding at a level angle, the stepping shell plates maintain a stable stepping situation, wherein at the two ends of the traversal process, the stepping shell plates traverse in a flat manner and do not produce a torque angle, thus enabling the entire training machine to utilize a simple structure to attain an effect of a healthy mountain climbing exercise.

DETAILED DESCRIPTION OF THE DRAWINGS

Figure 1:
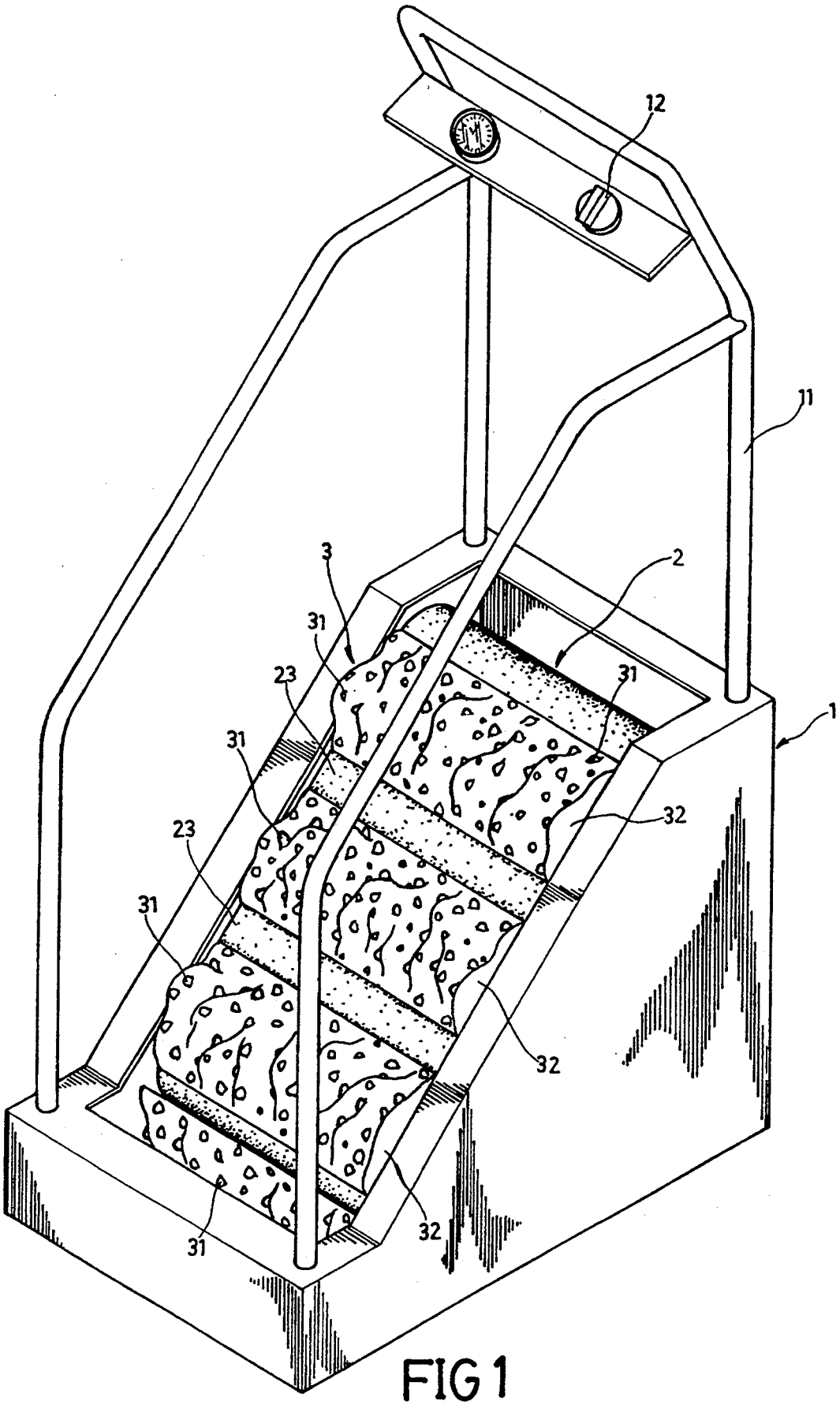
FIG. 1 is an isometric drawing of the invention herein.
Figure 2:
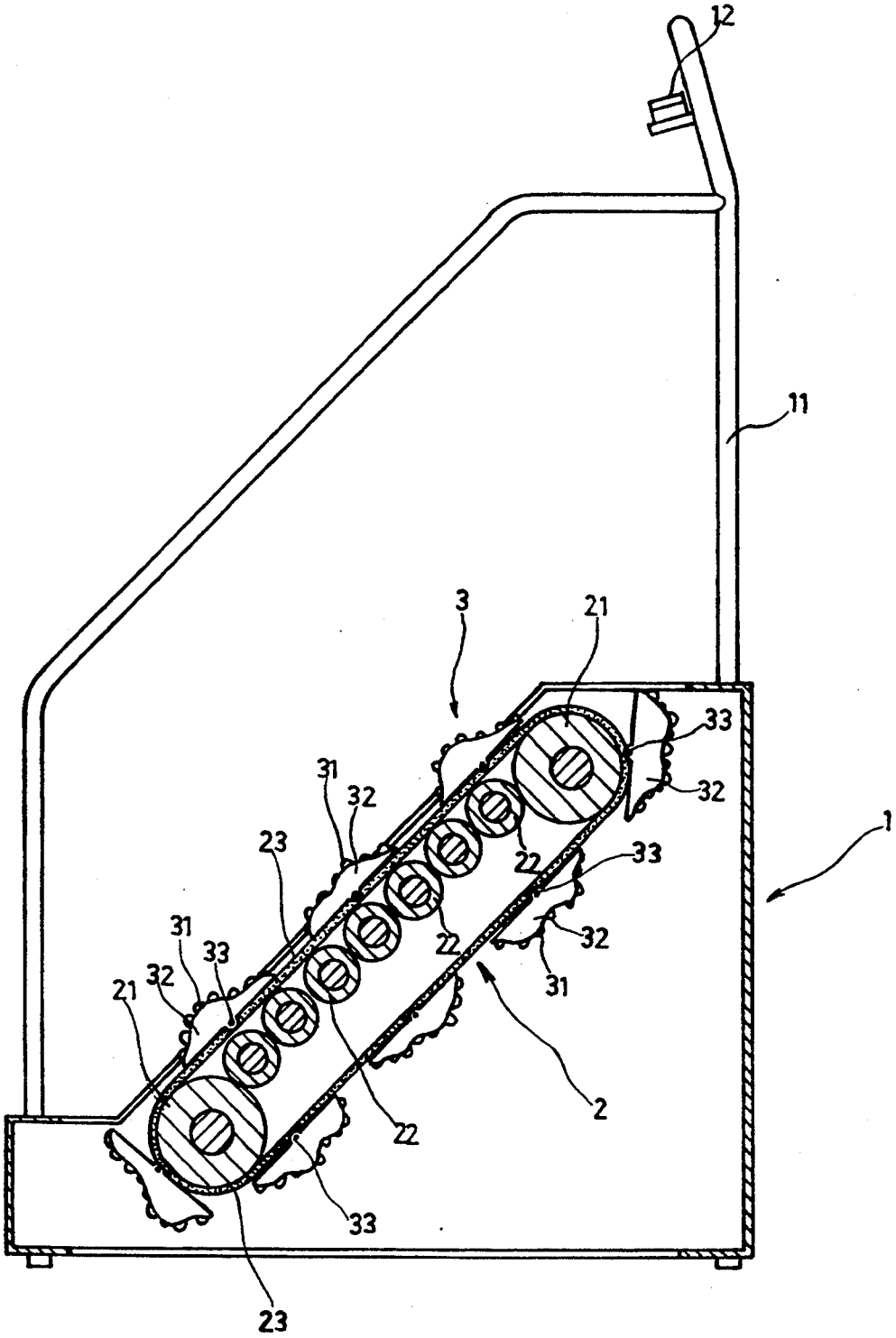
FIG. 2 is a cross-sectional drawing of the invention herein.
Figure 3:
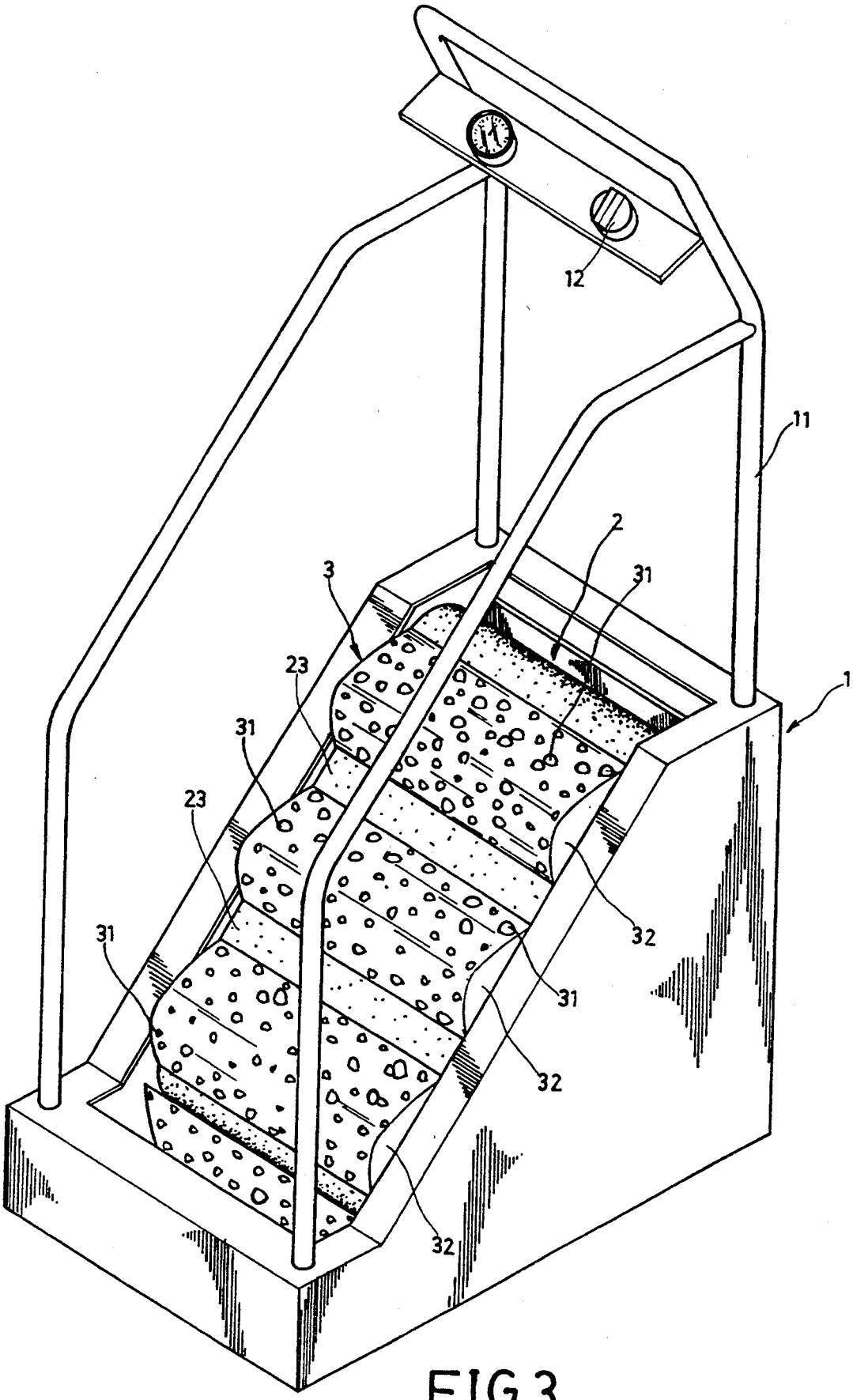
FIG. 3 is another isometric drawing of the preferred embodiment of the invention herein.
Figure 4:
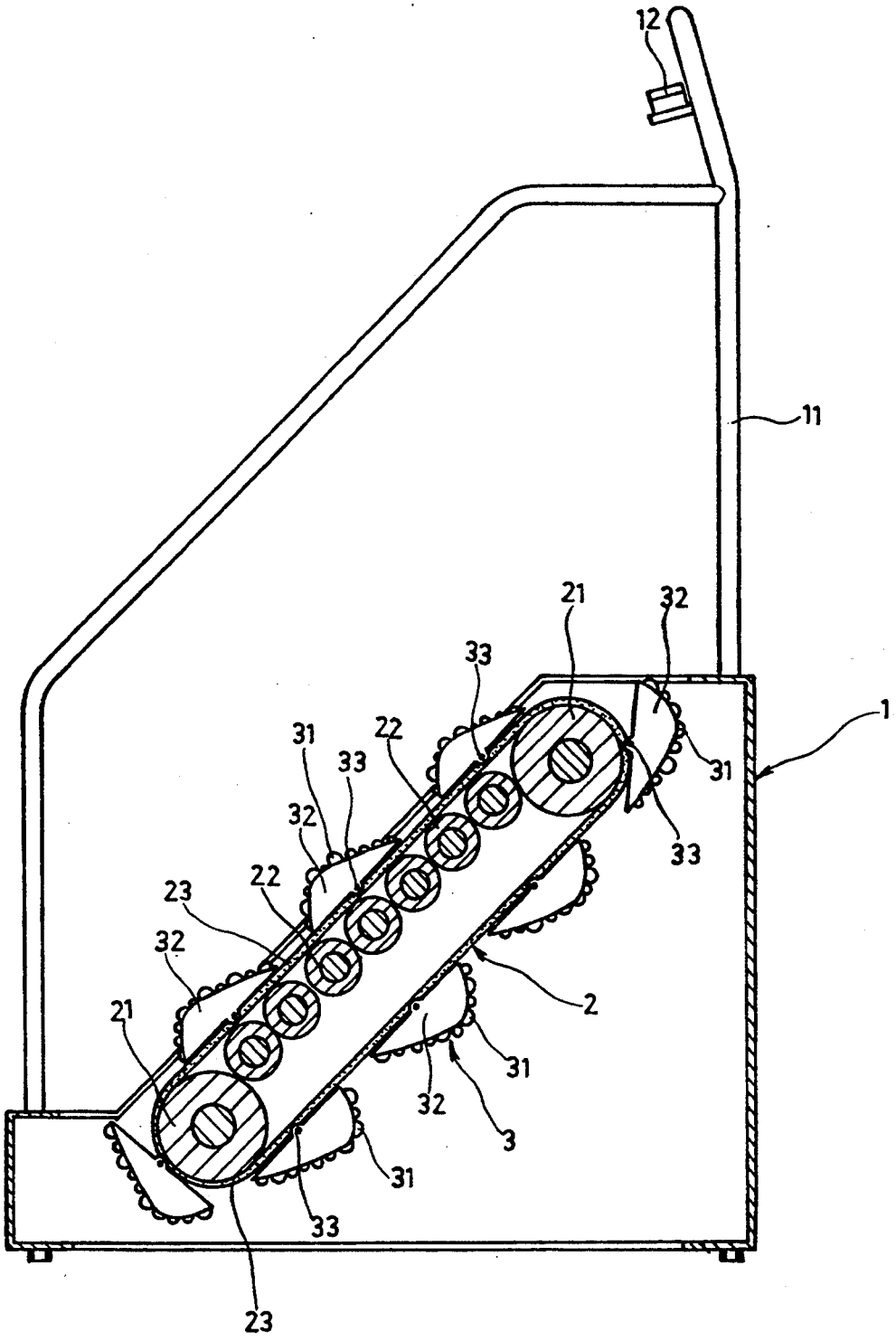
FIG. 4 is another cross-sectional drawing of the preferred embodiment of the invention herein.

The invention herein consists mainly of a machine base (1), a conveyor belt (2), shell plates (3) and other sections, of which the machine base (1) is not subject to limitations of external appearance and is primarily utilized as internal space for the frame and required equipage such as the shaft frame, the resistance adjuster structure and so on, enabling a section of the conveyor belt (2) to protrude, while also enabling the shell plates (3) on the conveyor belt (2) to provide stepping surface that can be utilized stably; a hand rail (11) or other accessory structures such as an adjustment knob (12) and so on can be installed onto the machine base (1) to allow the user to easily ascend in simulated mountain climbing; the structure of the conveyor belt (2) is such that it rotates on two large roller shafts (21) positioned at both ends of the conveyor belt (2), with a number of smaller roller shafts (22) and rungs (23) in between and, since this section is similar to the design of other types of running machines, therefore, it includes a roller shaft frame and resistance adjustment structure (this is used to adjust the rotating speed of the roller shafts) and other related design structures; the internal features on the invention herein are based on conventional technology and, since they can be designed by any technician familiar with this type of product, therefore, shall not be described further as the brief description of the drawings serve as ample depiction; the angle of incline produced by the rotating conveyor belt of the invention herein provides a feeling of climbing during operation and the main innovation of the invention herein is the positioning of the shell plates (3) and there are no limitations as the materials utilized for the shell plates (3), which can be formed out of plastic or stamped out of thin metal sheeting, with the thickness chosen according to the load onto the hump-shaped shell as constituted by the physical weight of the user during operation, and the shape is also not subject to limitations, as indicated in FIG. 1 and FIG. 2, the number of shell plates (3) are all of different shape, thus enabling the user to experience a surface variation with each step during operation and resulting in the feeling of actual mountain climbing; as indicated in FIG. 3 and FIG. 4, the external appearance of each shell plate (3) can be shaped in different degrees of irregularity in contour that is suited for contact with the sole of the foot; and the surface of each shell plate (3) features a number of rock-like protrusions (31) that are distributed over the entire stepping surface and this is common to the design of most conventional health walking machines; furthermore, the number of shell plates (3) can be arrayed at equal or unequal distances from the rungs (23) of the conveyor belt, with the two lateral ends (32) maintaining the continuity of the shell plates and increasing their overall safety, and in between each pair of lateral ends (32) is a node-shaped support point (33) and the support point (33) is utilized such that it is interlocked to the rungs (23) on the conveyor belt, thereby enabling the shell plates (3) to be tightly fastened on the rungs (23) of the conveyor belt to provide the user a flat stepping surface and, when moving around the roller shaft (21), reinforces the support point (33) while allowing free and even movement around the semi-circular surface of the roller shaft (21) as well as returning to a flat profile as the conveyor belt rotates back to its original position, therefore, the number of shell plates (3) on the rungs (23) of the conveyor belt easily and consistently complete the continuous rotation process. With further regard to interlocks positioned on both sides of the rungs (23) and the shell plates (3), after interlocking and the shell plates (3) may be subject to the problem of step length, or problems due to the protruding surface of the rungs (23) related to its positional softness, or problems due to the necessity of maintaining the noise level at the fastening point between the shell plates (3) and the rungs (23) and so on, however, since in terms of structure and length there are no technical problems and the technology can be included in the preferred embodiment of the invention herein, therefore these solutions will not described in further detail.

When the invention herein is being utilized, the user according to weight and rate of pace can initially, on the machine base (1), try stepping on the shell plates (3) on the rungs (23) and use the adjuster knob (12) to adjust the resistance of the rungs (23) on the conveyor belt and, after adjustment, tread on the shell plates (3), causing the shell plates (3) move downward and with the movement of the next level of shell plates (3), then produce a revolving exercise effect, wherein the external design and steps of the shell plates are of completely different appearance and, therefore, treading on the shell plates produces an interesting feeling of mountain climbing that attains the objective of sound physical health.

Therefore, the major objectives of the invention herein, with respect to utilization for physical exercise, is to provide a kind of new structure mountain climbing training machine which consists of the utilization of shell plates for treading that are interlocked at both sides of the rotating conveyor belt, enable these shell plates to have a simple structure capable of consistent rotation on the conveyor belt and allow the user to achieve an interesting exercise training session simulating mountain climbing.

What is claimed is:

1. A mountain climbing training machine comprising:

a machine base;

first and second cylindrical roller shafts rotatably mounted at spaced positions to said machine base;

an endless conveyor belt wrapped about said first and second roller shafts for rotation in a predetermined direction;

a plurality of shell plates, each of said shell plates defining a stepping surface having a plurality of rock-like protrusions distributed thereover; and means for pivotally attaching said plurality of shell plates at spaced locations in said predetermined direction along said endless conveyor belt.

2. The mounting climbing training machine according to claim 1, wherein said means for pivotally attaching said plurality of shell plates includes a plurality of support members, each of said support members extending between lateral ends of a respective one of said plurality of shell plates and being fastened to said endless conveyor belt, said plurality of shell plates being adapted to pivot about respective axes defined by said support members.

3. The mountain climbing training machine according to claim 2, wherein each of said plurality of shell plates includes first and second laterally extending end portions that are spaced in the predetermined direction of rotation of said endless conveyor belt, each of said plurality of support members extending between the lateral ends and intermediate the first and second end portions of its respective one of said plurality of shell plates.

* * * * *